US010875298B2

(12) United States Patent
Martin et al.

(10) Patent No.: US 10,875,298 B2
(45) Date of Patent: Dec. 29, 2020

(54) DELAY ELEMENTS FOR ACTIVATION SIGNALS

(71) Applicant: HEWLETT-PACKARD DEVELOPMENT COMPANY, L.P., Spring, TX (US)

(72) Inventors: Eric Martin, Corvallis, OR (US); Daryl E Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/484,720

(22) PCT Filed: Apr. 14, 2017

(86) PCT No.: PCT/US2017/027560
§ 371 (c)(1),
(2) Date: Aug. 8, 2019

(87) PCT Pub. No.: WO2018/190858
PCT Pub. Date: Oct. 18, 2018

(65) Prior Publication Data
US 2020/0039215 A1 Feb. 6, 2020

(51) Int. Cl.
*B41J 2/045* (2006.01)

(52) U.S. Cl.
CPC ..... *B41J 2/04573* (2013.01); *B41J 2/04533* (2013.01)

(58) Field of Classification Search
CPC ..... B41J 2/04573; B41J 2/04533
See application file for complete search history.

(56) References Cited

U.S. PATENT DOCUMENTS

| | | | |
|---|---|---|---|
| 5,508,724 | A | 4/1996 | Boyd et al. |
| 6,046,822 | A | 4/2000 | Wen et al. |
| 6,280,012 | B1 | 8/2001 | Schloeman et al. |
| 6,312,079 | B1 | 11/2001 | Anderson et al. |
| 6,454,389 | B1 | 9/2002 | Couwenhoven et al. |

(Continued)

FOREIGN PATENT DOCUMENTS

| | | |
|---|---|---|
| CN | 1061482 | 5/1992 |
| CN | 102781671 | 11/2012 |

(Continued)

OTHER PUBLICATIONS

Boley, J.W. et al., Effect of Print Masks on the Functional Performance of Inkjet Printed PD Hexadecanethiolate in Toluene, Jul. 18, 2013, <http://www.jwilliamboley.com/pdf/>.

(Continued)

*Primary Examiner* — Lamson D Nguyen
(74) *Attorney, Agent, or Firm* — Trop Pruner & Hu PC

(57) ABSTRACT

In some examples, a fluidic die includes a plurality of fluid actuators, and a controller to determine, based on input control information relating to controlling actuation of the plurality of fluid actuators, whether a first fluid actuator of the plurality of fluid actuators is to be actuated, and in response to determining that the first fluid actuator is to be actuated, activate a delay element associated with the first fluid actuator, the delay element to delay an activation signal propagated to selected fluid actuators of the plurality of fluid actuators in response to an actuation event.

20 Claims, 8 Drawing Sheets

(56) References Cited

U.S. PATENT DOCUMENTS

| | | | | |
|---|---|---|---|---|
| 6,705,691 | B2 | 3/2004 | Yamane et al. | |
| 6,932,453 | B2 | 8/2005 | Feinn et al. | |
| 8,016,389 | B2 | 9/2011 | Sheahan et al. | |
| 8,454,127 | B2 | 6/2013 | Nielsen et al. | |
| 8,529,038 | B2 | 9/2013 | Leighton et al. | |
| 8,651,632 | B2 | 2/2014 | Marcus et al. | |
| 9,061,521 | B2 | 6/2015 | Olson et al. | |
| 9,469,125 | B2 | 10/2016 | Humet et al. | |
| 9,475,286 | B2 | 10/2016 | Tuttnauer et al. | |
| 2003/0103105 | A1 | 6/2003 | Kawamura | |
| 2005/0190217 | A1 | 9/2005 | Wade et al. | |
| 2006/0268056 | A1 | 11/2006 | Molinet et al. | |
| 2013/0318282 | A1* | 11/2013 | Wakutsu | G06F 3/06 711/102 |
| 2014/0098385 | A1* | 4/2014 | Endo | B41J 2/04581 358/1.2 |
| 2016/0089885 | A1 | 3/2016 | Edelen et al. | |
| 2016/0303851 | A1 | 10/2016 | Shepherd | |
| 2017/0028724 | A1 | 2/2017 | Edelen et al. | |

FOREIGN PATENT DOCUMENTS

| | | |
|---|---|---|
| JP | 2003001820 A | 1/2003 |
| JP | 2017065048 | 4/2017 |
| WO | WO-2016068888 | 5/2016 |
| WO | WO2018/190855 | 10/2018 |
| WO | WO2018/190857 | 10/2018 |
| WO | WO2018/190859 | 10/2018 |

OTHER PUBLICATIONS

HP High Definition Nozzle Architecture, < http://www8.hp.com/h20195/v2/GetPDF.aspx/4AA6-1075ENW.pdf >.

* cited by examiner

| | | ACTUATION DATA | MASK DATA PATTERN | DELAY ACTIVE |
|---|---|---|---|---|
| VIRTUAL PRIMITIVE 0 | NOZZLE 0 | 1 | 0 | FALSE |
| | NOZZLE 1 | 1 | 1 | TRUE |
| | NOZZLE 2 | 1 | 0 | FALSE |
| | NOZZLE 3 | 1 | 0 | FALSE |
| | NOZZLE 4 | 1 | 0 | FALSE |
| | NOZZLE 5 | 1 | 0 | FALSE |
| | NOZZLE 6 | 1 | 0 | FALSE |
| | NOZZLE 7 | 1 | 0 | FALSE |
| VIRTUAL PRIMITIVE 1 | NOZZLE 8 | 1 | 0 | FALSE |
| | NOZZLE 9 | 1 | 1 | TRUE |
| | NOZZLE 10 | 1 | 0 | FALSE |
| | NOZZLE 11 | 1 | 0 | FALSE |
| | NOZZLE 12 | 1 | 0 | FALSE |
| | NOZZLE 13 | 1 | 0 | FALSE |
| | NOZZLE 14 | 1 | 0 | FALSE |
| | NOZZLE 15 | 1 | 0 | FALSE |
| VIRTUAL PRIMITIVE 2 | NOZZLE 16 | 1 | 0 | FALSE |
| | NOZZLE 17 | 1 | 1 | TRUE |
| | NOZZLE 18 | 1 | 0 | FALSE |
| | NOZZLE 19 | 1 | 0 | FALSE |
| | NOZZLE 20 | 1 | 0 | FALSE |
| | NOZZLE 21 | 1 | 0 | FALSE |
| | NOZZLE 22 | 1 | 0 | FALSE |
| | NOZZLE 23 | 1 | 0 | FALSE |
| VIRTUAL PRIMITIVE 3 | NOZZLE 24 | 1 | 0 | FALSE |
| | NOZZLE 25 | 1 | 1 | TRUE |
| | NOZZLE 26 | 1 | 0 | FALSE |
| | NOZZLE 27 | 1 | 0 | FALSE |
| | NOZZLE 28 | 1 | 0 | FALSE |
| | NOZZLE 29 | 1 | 0 | FALSE |
| | NOZZLE 30 | 1 | 0 | FALSE |
| | NOZZLE 31 | 1 | 0 | FALSE |
| VIRTUAL PRIMITIVE 4 | NOZZLE 32 | 1 | 0 | FALSE |
| | NOZZLE 33 | 1 | 1 | TRUE |
| | NOZZLE 34 | 1 | 0 | FALSE |
| | NOZZLE 35 | 1 | 0 | FALSE |
| | NOZZLE 36 | 1 | 0 | FALSE |
| | NOZZLE 37 | 1 | 0 | FALSE |
| | NOZZLE 38 | 1 | 0 | FALSE |
| | NOZZLE 39 | 1 | 0 | FALSE |
| VIRTUAL PRIMITIVE 5 | NOZZLE 40 | 1 | 0 | FALSE |
| | NOZZLE 41 | 1 | 1 | TRUE |
| | NOZZLE 42 | 1 | 0 | FALSE |
| | NOZZLE 43 | 1 | 0 | FALSE |
| | NOZZLE 44 | 1 | 0 | FALSE |
| | NOZZLE 45 | 1 | 0 | FALSE |
| | NOZZLE 46 | 1 | 0 | FALSE |
| | NOZZLE 47 | 1 | 0 | FALSE |
| | | 404 | 406 | 502 |

FIG. 5

| | | ACTUATION DATA | MASK DATA PATTERN | DELAY ACTIVE |
|---|---|---|---|---|
| VIRTUAL PRIMITIVE 0 | NOZZLE 0 | 1 | 0 | FALSE |
| | NOZZLE 1 | 1 | 1 | TRUE |
| | NOZZLE 2 | 0 | 0 | FALSE |
| | NOZZLE 3 | 1 | 0 | FALSE |
| VIRTUAL PRIMITIVE 1 | NOZZLE 4 | 0 | 0 | FALSE |
| | NOZZLE 5 | 1 | 1 | TRUE |
| | NOZZLE 6 | 1 | 0 | FALSE |
| | NOZZLE 7 | 0 | 0 | FALSE |
| VIRTUAL PRIMITIVE 2 | NOZZLE 8 | 0 | 0 | FALSE |
| | NOZZLE 9 | 0 | 1 | FALSE |
| | NOZZLE 10 | 1 | 0 | FALSE |
| | NOZZLE 11 | 1 | 0 | FALSE |
| VIRTUAL PRIMITIVE 3 | NOZZLE 12 | 1 | 0 | FALSE |
| | NOZZLE 13 | 0 | 1 | FALSE |
| | NOZZLE 14 | 0 | 0 | FALSE |
| | NOZZLE 15 | 1 | 0 | FALSE |
| VIRTUAL PRIMITIVE 4 | NOZZLE 16 | 1 | 0 | FALSE |
| | NOZZLE 17 | 0 | 1 | FALSE |
| | NOZZLE 18 | 1 | 0 | FALSE |
| | NOZZLE 19 | 0 | 0 | FALSE |
| VIRTUAL PRIMITIVE 5 | NOZZLE 20 | 0 | 0 | FALSE |
| | NOZZLE 21 | 1 | 1 | TRUE |
| | NOZZLE 22 | 0 | 0 | FALSE |
| | NOZZLE 23 | 1 | 0 | FALSE |
| VIRTUAL PRIMITIVE 6 | NOZZLE 24 | 1 | 0 | FALSE |
| | NOZZLE 25 | 1 | 1 | TRUE |
| | NOZZLE 26 | 0 | 0 | FALSE |
| | NOZZLE 27 | 0 | 0 | FALSE |
| VIRTUAL PRIMITIVE 7 | NOZZLE 28 | 0 | 0 | FALSE |
| | NOZZLE 29 | 1 | 1 | TRUE |
| | NOZZLE 30 | 1 | 0 | FALSE |
| | NOZZLE 31 | 0 | 0 | FALSE |
| VIRTUAL PRIMITIVE 8 | NOZZLE 32 | 0 | 0 | FALSE |
| | NOZZLE 33 | 0 | 1 | FALSE |
| | NOZZLE 34 | 1 | 0 | FALSE |
| | NOZZLE 35 | 1 | 0 | FALSE |
| VIRTUAL PRIMITIVE 9 | NOZZLE 36 | 1 | 0 | FALSE |
| | NOZZLE 37 | 0 | 1 | FALSE |
| | NOZZLE 38 | 0 | 0 | FALSE |
| | NOZZLE 39 | 1 | 0 | FALSE |
| VIRTUAL PRIMITIVE 10 | NOZZLE 40 | 1 | 0 | FALSE |
| | NOZZLE 41 | 0 | 1 | FALSE |
| | NOZZLE 42 | 1 | 0 | FALSE |
| | NOZZLE 43 | 0 | 0 | FALSE |
| VIRTUAL PRIMITIVE 11 | NOZZLE 44 | 1 | 0 | FALSE |
| | NOZZLE 45 | 1 | 1 | TRUE |
| | NOZZLE 46 | 0 | 0 | FALSE |
| | NOZZLE 47 | 0 | 0 | FALSE |
| | | 404 | 406 | 602 |

FIG. 6

DELAY ELEMENTS FOR ACTIVATION SIGNALS

BACKGROUND

Fluid control devices such as fluidic dies can control movement and ejection of fluid. Such fluidic dies may include fluid actuators that may be actuated to cause displacement of fluid. Some example fluidic dies may include printheads, where fluids used by the printheads can include ink or other types of fluids.

BRIEF DESCRIPTION OF THE DRAWINGS

Some implementations of the present disclosure are described with respect to the following figures.

FIGS. 5 and 6 illustrate examples of virtual primitives, actuation data, mask data patterns, and whether delays are activated, according to some examples.

Figure 1:
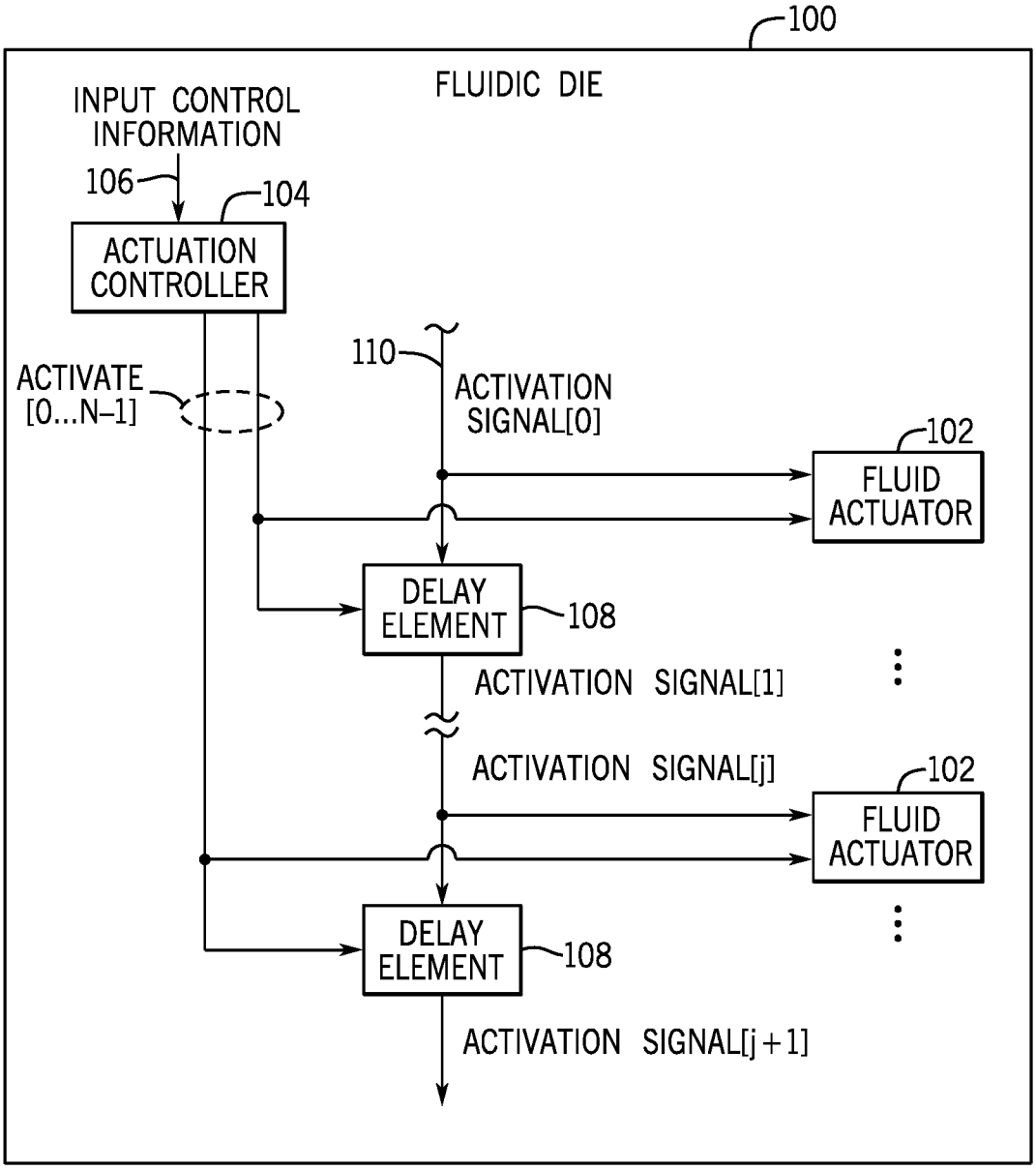
FIG. 1 is a block diagram of a fluidic die according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid control device can include multiple fluid actuators that when actuated cause displacement of fluid. For example, the fluid control device can control ejection of a fluid from an orifice of the fluid control device towards a target. In such examples, the fluid control device can be referred to as a fluid ejection device that is able to control ejection of fluids. In some examples, fluid ejection devices can include printheads that are used in two-dimensional (2D) or three-dimensional (3D) printing. In 2D printing, a printhead can eject ink or other printing fluid directed to a target substrate (e.g., paper, plastic, etc.) to print a pattern onto the target substrate. In 3D printing, a printhead can eject a fluid used to form a 3D target object. A 3D printing system can form the 3D target object by depositing successive layers of build material. Printing fluids dispensed from the 3D printing system can include ink, as well as fluids used to fuse powders of a layer of build material, detail a layer of build material (such as by defining edges or shapes of the layer of build material), and so forth.

In other examples, a fluid control device can include pumps that control fluid flows through respective fluid channels. More generally, a fluid control device can be used in either a printing application or a non-printing application. Examples of fluid control devices used in non-printing applications include fluid control devices in fluid sensing systems, medical systems, vehicles, fluid flow control systems, and so forth. In a printing application, a fluid control device, such as a fluidic die, can be mounted onto a print cartridge, where the print cartridge can be removably mounted in a print system. For example, the fluidic die can be a printhead die that is mounted to the print cartridge. In another example of a printing application, fluid control devices (such as fluidic dies) can be mounted onto a print bar that spans the width of a target medium (e.g., a paper medium or medium of another material) onto which printing fluids are to be dispensed.

A fluid control device can include multiple fluid actuators that when actuated causes displacement of fluid. As used here, displacement of fluid can refer to movement of fluid within a fluid channel inside the fluid control device, or to ejection of fluid from inside a fluid chamber of the fluid control device through an orifice to a region outside the fluid control device.

An activation signal (also referred to as a "fire pulse") can be used to actuate the fluid actuators. The activation signal can be asserted to an active state for a specified time duration (the specified time duration of the active state of the activation signal is the pulse width of the activation signal). When the activation signal is asserted to the active state, selected fluid actuators are actuated, where the selection of fluid actuators is based on input control information as discussed further below. While the activation signal is deasserted to an inactive state, fluid actuators cannot be actuated.

The multiple fluid actuators of a fluid control device can be partitioned into "primitives" (also referred to as "firing primitives"), where a primitive includes a group of a certain number of fluid actuators. A number of fluid actuators included in a primitive can be referred to as a size of the primitive. Traditionally, primitives of a fluid control device are configured using hardware circuitry, and thus a size of the primitives used in the fluid control device is fixed. To reduce a peak current when actuating fluid actuators in the primitives, and to minimize power supply transients associated with simultaneous actuation of multiple fluid actuators, a delay can be used to delay the activation signal so that the actuation of fluid actuators between the primitives is correspondingly delayed. In fixed-size primitives, one delay element is provided per primitive. Each fluid actuator of a primitive can be uniquely addressed to select the fluid actuator.

In accordance with some implementations of the present disclosure, variable-sized primitives can be used in a fluid control device. For a first actuation event (or a first set of actuation events), primitives of a first primitive size can be used, while for a second actuation event (or second set of actuation events), primitives of a second primitive size (different from the first primitive size) can be used. Varying sizes of primitives can be implemented by using different mask data patterns in a mask register of the fluid control device. A first mask data pattern can specify the first primitive size, while a second mask data pattern can specify the second primitive size.

In arrangements that allow variable-sized primitives according to some implementations of the present disclosure, each fluid actuator can be individually associated with a delay element for delaying an activation signal. The delay elements are daisy chained one to another, so are arranged in series. A delay element is associated with each individual fluid actuator because, in response to a given actuation event, just a respective subset of fluid actuators (where the subset can include just one fluid actuator or some other number of fluid actuators) in each virtual primitive is actuated. For another actuation event, another subset of fluid actuators in each virtual primitive is actuated.

An actuation event can refer to concurrent actuation of fluid actuators of a fluid control device to cause corresponding fluid displacement.

To avoid excessive delays from being applied to the activation signal, the delay elements individually associated with the fluid actuators can be selectively activated and deactivated, based on a determination of whether or not each fluid actuator is to be actuated. A delay element for an active fluid actuator (a fluid actuator to be actuated) can be activated to delay the activation signal, while a delay element for an inactive fluid actuator (a fluid actuator that is not to be actuated) is deactivated to not delay the activation signal. Note that if the activation signal is subjected to delays of all of the delay elements (arranged in series) that are associated with individual fluid actuators, then a large delay can be imposed on the activation signal. Excessive delay of the activation signal can reduce the speed at which fluid displacement operations (e.g., printing operations) can be performed.

FIG. 1 is a block diagram of an example fluidic die 100. A fluidic die can refer to a structure that includes a substrate on which are provided various layers (e.g., thin film layers) to form fluid channels, orifices, fluid actuators, fluid chambers, electrical conductors, and so forth.

The fluidic die 100 includes multiple fluid actuators 102. The fluid actuators 102 can be arranged as an array of fluid actuators, which can be a 1-dimensional (1D) array of fluid actuators or a two-dimensional (2D) array of fluid actuators. In other examples, the fluid actuators 102 can be arranged in a different pattern.

Although FIG. 1 depicts various components of a fluidic die, it is noted that in other examples, similar components can be arranged in other types of fluid control devices.

In some examples, a fluid actuator 102 can be disposed in a nozzle of the fluidic die 100, where the nozzle may include a fluid chamber and a nozzle orifice in addition to the fluid actuator. The fluid actuator may be actuated such that displacement of fluid in the fluid chamber may cause ejection of a fluid drop through the nozzle orifice. Accordingly, a fluid actuator disposed in a nozzle may be referred to as a fluid ejector.

A fluid actuator 102 can include an actuator that includes a piezoelectric membrane, an actuator that includes a thermal resistor, an actuator that includes an electrostatic membrane, an actuator that includes a mechanical/impact driven membrane, an actuator that includes a magneto-strictive drive actuator, or other such elements that may cause displacement of fluid responsive to electrical actuation or actuation resulting from another type of input stimulus.

In some examples, the fluidic die 100 can include microfluidic channels. Microfluidic channels may be formed by performing etching, microfabrication (e.g., photolithography), micromachining processes, or any combination thereof in a substrate of the fluidic die 100. A microfluidic channel may include a fluid channel of specified small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

Some example substrates of fluidic dies can include silicon based substrates, glass based substrates, gallium arsenide based substrates, and/or other such suitable types of substrates for micro fabricated devices and structures. Accordingly, microfluidic channels, chambers, orifices, and/or other such features may be defined by surfaces fabricated in the substrate of the fluidic die 100. The fluid actuators 102 (or a subset of the fluid actuators 102) can be disposed in respective microfluidic channels. In such examples, actuation of a fluid actuator 102 disposed in a microfluidic channel can generate fluid displacement in the microfluidic channel. Accordingly, a fluid actuator 102 disposed in a microfluidic channel may be referred to as a fluid pump.

The fluidic die 100 includes an actuation controller 104. A "controller" as used herein can refer to any hardware processing circuit, which can include logic circuitry, a microprocessor, a core of a multi-core microprocessor, a microcontroller, a programmable gate array, a programmable integrated circuit device, or any other hardware processing circuit. In further examples, a controller can include a combination of a hardware processing circuit and machine-readable instructions executable on the hardware processing circuit.

The actuation controller 104 receives input control information 106 relating to controlling an actuation of the fluid actuators 102. Based on the input control information 106, the actuation controller 104 determines which of the fluid actuators 102 are to be actuated. Note that not all of the fluid actuators 102 would be actuated in response to the input control information 106 in some examples.

As explained further below, the input control information 106 is based on the content of various registers.

The actuation controller 104 produces various Activate outputs. More specifically, the actuation controller 104 produces N ($N \geq 2$) Activate outputs for N fluid actuators 102: Activate[0 . . . N−1]. An Activate[i] output, i=0 to N−1, is asserted to an active state (e.g., "1") in response to the input control information 106 selecting a corresponding fluid actuator i for actuation. On the other hand, the actuation controller 104 deasserts the Activate[i] output to an inactive state in response to the actuation controller 104 determining, based on the input control information 106, that the respective fluid actuator i is not to be actuated.

Each Activate[i] output can be in the form of a signal or any other indication (e.g., a message, an information field, etc.) that can be used to control actuation of the respective fluid actuator i.

As depicted in FIG. 1, each Activate[i] output is provided to an input of a respective fluid actuator 102. Additionally, in accordance with some implementations of the present disclosure, each Activate[i] output is provided to a control input of a respective delay element 108.

FIG. 1 shows a chain of delay elements 108 that are to sequentially delay an activation signal 110. The activation signal 110 can be received by the fluidic die 100 from circuitry external of the fluidic die 100, such as from a system controller of a fluid control system. In other examples, the activation signal 110 can be generated internally in the fluidic die 100.

Each of the multiple delay elements 108 is associated with a respective fluid actuator 102.

The instance of the activation signal that is received at the input of the chain of delay elements 108 is referred to as activation signal[0]. Activation signal[0] is provided to the input of a first delay element 108, which can selectively delay (or not) activation signal[0]. The output of the first delay element 108 is another activation signal instance, referred to as activation signal[1]. Further down the chain of delay elements 108, a further activation signal instance, activation signal[j], is provided to the input of a further delay element 108, which can selectively delay (or not) activation signal[j]. The output of the further delay element 108 is another activation signal instance, activation signal[j+1].

Each fluid actuator i receives the corresponding Activate [i] output from the actuation controller 104 and a respective instance of the activation signal (activation signal[i]) from the chain of delay elements 108. The combination of the respective activation signal[i] (being at an active state) and the respective Activate[i] output (being asserted to an active state) causes an activation circuit in the respective fluid actuator i to actuate fluid actuator i.

Each Activate[i] output from the actuation controller 104 also controls the activation or deactivation of a respective delay element 108. Delay element i is activated in response to the corresponding Activate[i] output being asserted to an active state. Activated delay element i delays a corresponding activation signal instance, activation signal[i], by a target delay amount (as provided by a delay circuit in delay element i), and outputs the next activation signal instance, activation signal[i+1]. In contrast, a delay element i is deactivated (such that delay element i does not delay activation signal[i] by the target delay amount) in response to the Activate[i] output being deasserted to an inactive state.

Thus, when a given fluid actuator 102 is not to be activated, then the respective delay element 108 remains inactive, such that the deactivated delay element 108 does not delay the activation signal 110 by the target delay amount of a delay element.

Each activation signal instance produced in the chain of delay elements 108 can be delayed a different amount relative to the input activation signal 110 (activation signal [0]) depending on how many delay elements upstream in the chain of delay elements 108 were active.

More generally, the actuation controller 104 is to, in response to determining that a given fluid actuator 102 is to be actuated, activate a respective delay element associated with the given fluid actuator 102, where the delay element is to delay an activation signal instance propagated to selected fluid actuators of multiple fluid activators in response to an actuation event.

Further, the actuation controller 104 determines, based on the input control information 106, a first subset of the fluid actuators 102 that are to be actuated, and a second subset of the fluid actuators 102 that are not to be actuated, and activates delay elements 108 associated with the first subset of the fluid actuators 102 to delay the activation signal 110, and deactivates delay elements associated with second subset of fluid actuators 102

Figure 2:
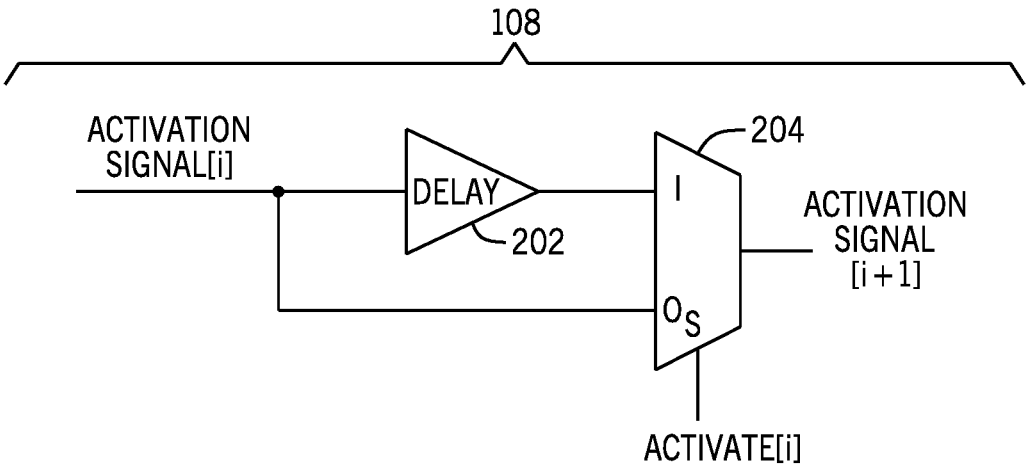
FIG. 2 is a schematic diagram of a delay element according to some examples.

FIG. 2 is a schematic diagram of a delay element 108 according to some examples. The delay element 108 includes a delay circuit 202, which receives as input an activation signal[i] (which corresponds to an activation signal instance along the chain of delay elements 108). The delay circuit 202 can be implemented with any or various types of circuitry. For example, the delay circuit 202 can include a combination of a resistor and a capacitor that in combination causes a delay in the transition of a signal. In other examples, the delay circuit 202 can include a series of inverters or buffers, where the series of inverters or buffers adds a delay to activation signal[i]. As yet another example, the delay circuit 202 can be a flip-flop that is clocked by a clock signal. This causes the delay time to be the period of the clock.

The output of the delay circuit 202 is provided to the "1" input of a multiplexer 204, while activation signal[i] is provided to the "0" input of the multiplexer 204. A "multiplexer" can refer to any logic that is able to select from among multiple inputs, where the selected input is provided to the output of the multiplexer.

Selection of the "0" input or the "1" input of the multiplexer 204 is controlled by an Activate[i] output from the actuation controller 104. The Activate[i] output is provided to the select control input of the multiplexer 204. If the Activate[i] output is set to an inactive state (e.g., "0"), then the "0" input of the multiplexer 204 is selected, and activation signal[i] is propagated through the multiplexer 204 to the output of the multiplexer 204 as output activation signal[i+1]. Selecting the "0" input of the multiplexer 204 effectively bypasses the delay circuit 202, such that activation signal[i] is not delayed by the target delay amount of the delay circuit 202.

On the other hand, if the Activate[i] output is asserted to an active state (e.g., "1"), then the "1" input of the multiplexer 204 is selected, and the output of the delay circuit 202 is selected and propagated through the multiplexer 204 to the output of the multiplexer 204 as output activation signal[i+1].

In other examples, activation signal[i] can be connected to the "1" input of the multiplexer 204, while the output of the delay circuit 202 is connected to the "0" input of the multiplexer 204. The Activate[i] input to the select control input of the multiplexer 204 would be inverted in such examples. In yet further examples, different logic for selectively delaying or not activation signal[i] can be used in the delay element 108.

Figure 3:
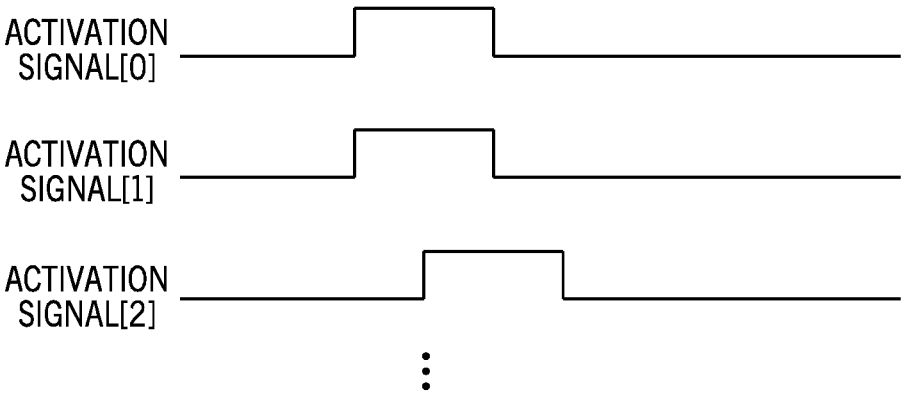
FIG. 3 is a timing diagram of delayed instances of activation signals according to some examples.

FIG. 3 is a timing diagram showing various activation signal instances: activation signal[0], activation signal[1], and activation signal[2]. In FIG. 3, activation signal[0] corresponds to the (un-delayed) activation signal 110 that is input to the chain of delay elements 108 shown in FIG. 1.

In the example of FIG. 3, it is assumed that delay element 0 is not activated. As a result, activation signal[1] that is output from delay element 0 is not delayed by the delay amount of the delay circuit 202 (FIG. 2) of delay element 0, as shown in FIG. 3 (note that there may be a slight delay of activation signal[1] relative to activation signal[0] due to the signal passing through the logic of delay element 0, including the multiplexer 204).

It is assumed in the example of FIG. 3 that delay element 1 (which receives as input activation signal[1] and outputs activation signal[2]) is activated. FIG. 3 shows activation signal[2] delayed by the delay amount of the delay circuit 202 (FIG. 2) of delay element 1. The activation signal instances are successively propagated through respective delay elements in the chain, where some of the activation signal instances may be delayed by activated delay elements while others are not delayed by deactivated delay elements.

Figure 4:
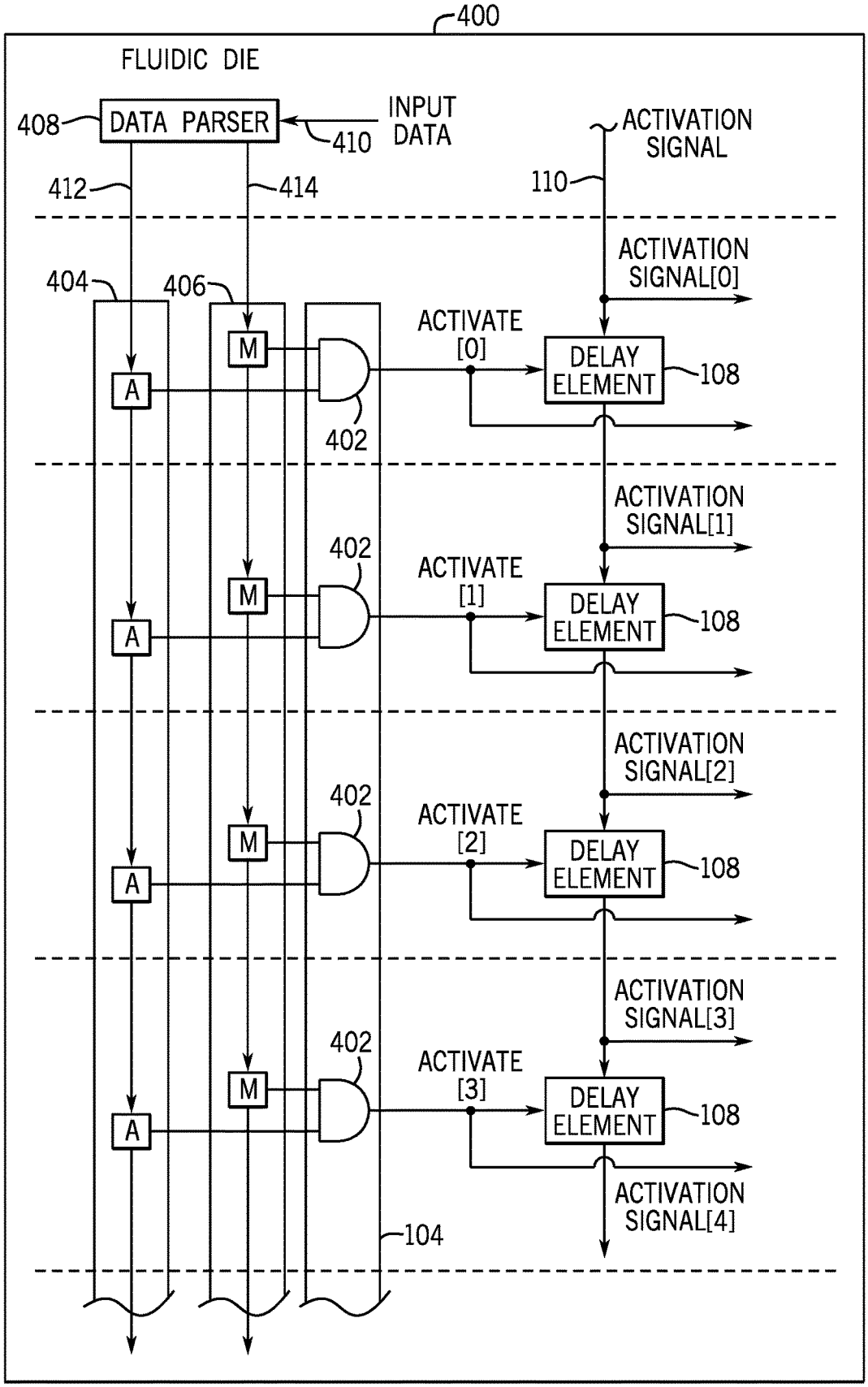
FIG. 4 is a block diagram of a fluidic die according to further examples.

FIG. 4 is a schematic diagram of a fluidic die 400 according to further examples. FIG. 4 shows logic associated with controlling the activation of four respective fluid actuators. It is noted that further logic is provided for actuating additional fluid actuators. In some examples, the fluid actuators that are being actuated by the logic shown in FIG. 4 can be part of a column of fluid actuators.

In FIG. 4, the actuation controller 104 includes a number of AND functions 402 that receive actuation data from an actuation data register 404 and mask data from a mask register 406. In some examples, the input control information 106 of FIG. 1 includes the actuation data in the actuation data register 404 and the mask data in the mask register 406. A "register" can refer to any storage element that can be used to store data. For example, a register can be part of a portion of a memory device, such as a dynamic random access memory (DRAM), a static random access memory (SRAM), a flash memory, or any other type of memory device. Alternatively, a register can refer to a storage buffer, a data latch, or any other data holding device that can temporarily or persistently store data.

An AND function receives multiple inputs, and produces an active output if all of the multiple inputs are at the active state. Although AND functions are depicted in FIG. 4, it is noted that in other examples, other logic in the actuation controller 104 for producing the Activate[0 . . . N−1] outputs based on the actuation data and the mask data can be used. The concept is that an Activate[i] output for actuating a respective fluid actuator is set to an active value in response to both the corresponding actuation data bit (or other value) in the actuation data and the mask data bit (or other value) in the mask data being set to an active value. More generally, the actuation controller 104 is to combine a value in the actuation data register 404 with a corresponding value in the mask register 406 to determine whether a respective fluid actuator is to be actuated.

The actuation data register 404 can store actuation data that indicates each fluid actuator to actuate for a set of actuation events. Actuating a fluid actuator refers to causing operation of the fluid actuator to perform fluid displacement in the fluidic die 100. As noted above, an actuation event can refer to concurrent actuation of fluid actuators of the fluidic die 100 to cause fluid displacement. An actuation event can be responsive to a command issued to the fluidic die, or a command issued in the fluidic die, to cause fluid displacement to occur. A "set of actuation events" can refer to any sequence or collection of events that can cause respective different groups of fluid actuators 102 to actuate.

Assuming there are N (N≥2) fluid actuators 102, the actuation data stored in the actuation data register 404 includes N values that correspond to the N fluid actuators 102. In some examples, each value (represented as "A" in FIG. 4) of the N values can be provided by a single bit, where a first state of the bit indicates that the corresponding fluid actuator 102 is to be actuated, and a different second state of the bit indicates that the corresponding fluid actuator 102 is to remain un-actuated. In other examples, each value of the N values in the actuation data can be represented using multiple bits, where a first value of the multiple bits indicates that a corresponding fluid actuator 102 is to be actuated, and a different second value of the multiple bits indicates that the corresponding fluid actuator 102 is to remain un-actuated.

The mask register 406 can store a mask data pattern that indicates a subset of the fluid actuators 102 that is (are) enabled for actuation for a respective actuation event or the set of actuation events. Enabling a fluid actuator for actuation can refer to allowing the fluid actuator to be activated in response to a value of the actuation data in the actuation data register 404 specifying that the fluid actuator is to be actuated.

A mask data pattern stored in the mask register 406 can have N values that correspond to N fluid actuators 102. Each value (represented as "M" in FIG. 4) of the N values in the mask data pattern can be provided by a single bit or can be provided by multiple bits.

If a value of a mask data pattern indicates that a particular fluid actuator is not enabled for actuation, then the particular fluid actuator will not be actuated even though the actuation data stored in the actuation data register 404 specifies that the particular fluid actuator 102 should be actuated. On the other hand, if a mask data pattern specifies that the particular fluid actuator is enabled for actuation, the particular fluid actuator is actuated only if the actuation data stored in the actuation data register 404 specifies that the particular fluid actuator is to be actuated. More specifically, a given fluid actuator 102 is to be actuated in response to both a value ("A") of the actuation data register 404 specifying that the given fluid actuator 102 is to be actuated, and a corresponding value ("M") of the mask data pattern enabling actuation of the given fluid actuator 102.

In the example of FIG. 4, an "A" bit from the actuation data register 404 is provided to a first input of a respective AND function 402 in the actuation controller 104, and an "M" bit from the mask register 406 is provided to a second input of the respective AND function 402. If both input bits are active (e.g., "1"), then the AND function 402 asserts the respective Activate[i] output to an active state.

FIG. 4 shows the activation signal 110 propagated through a chain of delay elements 108. In FIG. 4, a first (un-delayed) activation signal instance, activation signal[0], and the Activate[0] output from the actuation controller 104 are provided to fluid actuator 0, a second (possibly) delayed activation signal instance, activation signal[1], and the Activate[1] output are provided to fluid actuator 1, a third (possibly) delayed activation signal instance, activation signal[2], and the Activate[2] output are provided to fluid actuator 2, and so forth. Each delay element 108 causes a specified respective delay to be applied to the activation signal 110 when the delay element 108 is activated by the corresponding Activate[i] signal being active.

FIG. 4 further shows a data parser 408 that receives input data 410. The input data 410 can be provided by a fluid control system to the fluidic die 400. In different phases of operation, the data parser 408 causes loading of the actuation data register 404 and the mask register 406. The data parser 408 is a form of data loading logic to control loading of data into respective registers. The data parser 408 writes column actuation data 412 into the actuation data register 404 during a fluid displacement phase, during which the fluidic die 400 causes displacement of fluid (e.g., eject fluid during a printing operation). The data parser 408 writes a mask data pattern 414 into the mask register 406 during a mask register write phase, which can be part of initialization of the fluidic die 400, as well as in subsequent phases when updating of the mask data pattern in a mask register is to be performed.

In some examples, different mask data patterns can be written to the mask register 406. One example use case of writing different mask data patterns to the mask register 406 is to set a different primitive size. For example, for a first set of actuation events, a first mask data pattern can be written to the mask register 406 to set a first primitive size, for a second set of actuation events, a second mask data pattern can be written to the mask register 406 to set a second primitive size, and so forth.

In other examples, instead of using just one mask register 406, multiple mask registers can be included in the fluidic die 400, where the multiple mask registers can store different mask patterns. A multiplexer (not shown) can be provided to select from among the multiple mask registers to select the mask data pattern to use.

FIG. 5 depicts an example in which nozzles 0-47 (which include respective fluid actuators) of a fluidic die are divided into six virtual primitives (0-5). Each virtual primitive has eight nozzles (a primitive size of 8). Each of the eight nozzles in a virtual primitive is associated with a respective unique address. The eight bits in the mask data pattern corresponding to the eight nozzles of a given virtual primitive are used to address the respective eight nozzles.

FIG. 5 shows an example actuation data in the actuation data register 404, where the example actuation data includes all "1"s. FIG. 5 also shows an example mask data pattern in the mask register 406. In each virtual primitive, the mask data pattern effectively selects address 1, while the remaining addresses remain deselected. A Delay Active column 502 indicates which delay elements (associated with respective nozzles) are activated ("TRUE") and which delay elements remain deactivated ("FALSE").

FIG. 6 shows another example where the 48 nozzles are divided into 12 virtual primitives, with each virtual primitive including four nozzles (a primitive size of 4). In the example of FIG. 6, the actuation data register 404 includes actuation data different from the actuation data of FIG. 5. Instead of all "1"s as in FIG. 5, FIG. 6 shows a lower density actuation data pattern, such as for use in printing text. The Delay Active column 602 shows which delay elements are activated ("TRUE"), and which ones remain deactivated ("FALSE").

The mask data pattern in the mask register 406 in the fluidic die 400 of FIG. 4 can be shifted for respective actuation events of a set of actuation events. As noted above, in some examples, within a given virtual primitive, just one fluid actuator of the virtual primitive is actuated in response to a respective actuation event. To actuate all of the fluid actuators of the virtual primitive, a set of actuation events are provided, where each successive actuation event of the set corresponds to actuation of a next fluid actuator of the virtual primitive.

Figures 7A, 7B, 7C, 7D:
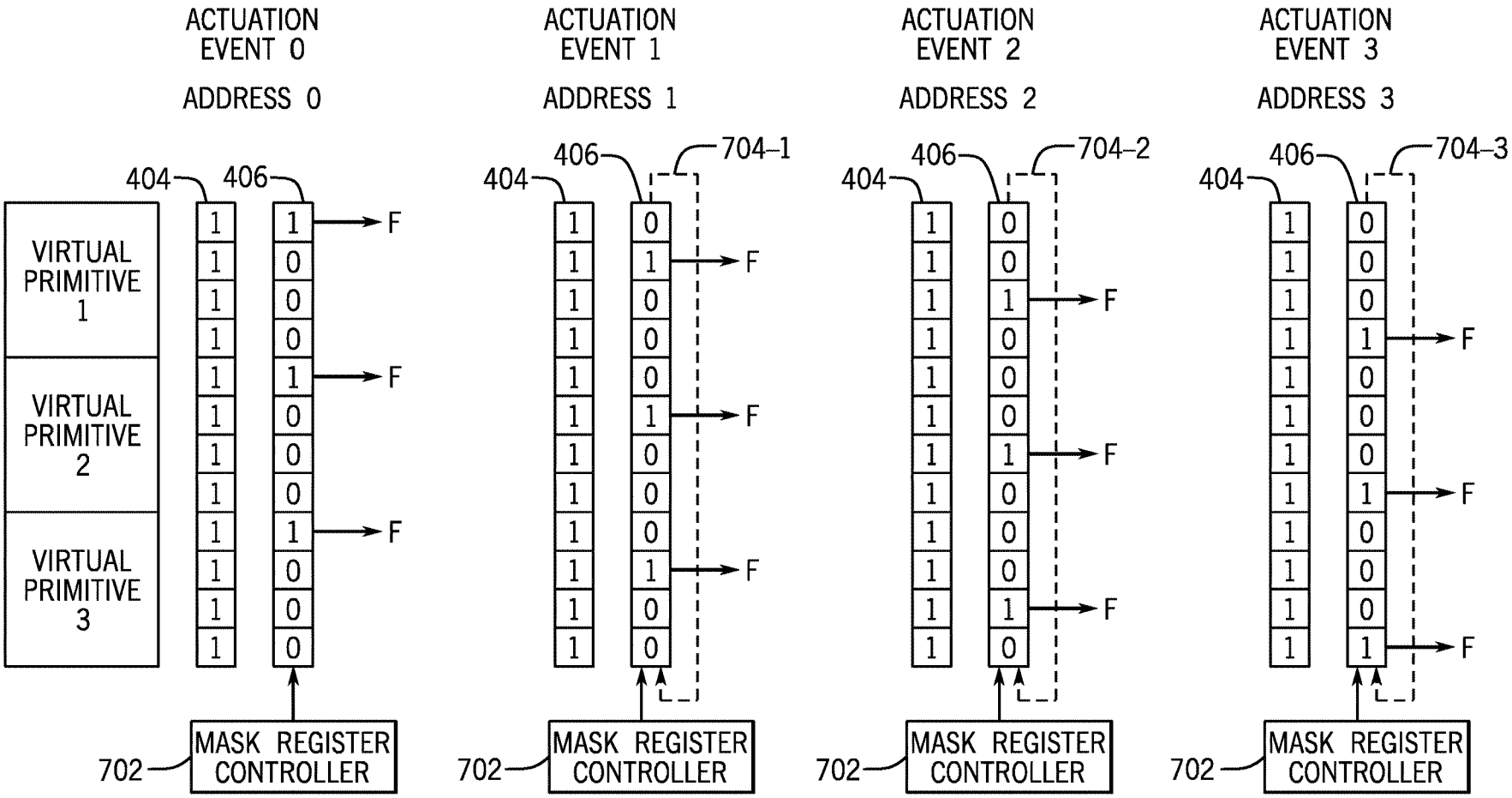
FIGS. 7A-7D illustrate shifting of a mask data pattern in a mask register, according to additional examples.

The shifting operation of the mask data pattern in the mask register 406 can be controlled by a mask register controller 702, as shown in FIGS. 7A-7D. FIGS. 7A-7D show an example where a mask data pattern (in the mask register 406) indicates a primitive size of four, i.e., each virtual primitive has four fluid actuators. Assuming a column of 12 fluid actuators, the column is divided into three virtual primitives 1, 2, and 3 (as shown in FIG. 7A). A set of four actuation events (actuation event 0, actuation event 1, actuation event 2, and actuation event 3) is provided to cause actuation of the four fluid actuators in each virtual primitive at four successive times.

FIG. 7A shows actuation event 0, in which address 0 is selected by the mask data pattern in the mask register 406. The fluid actuators in the three virtual primitives assigned address 0 are enabled for actuation. The actuation data register 404 contains all "1"s in the example, while the mask data pattern of the selected mask register 406 contains the following mask data pattern: 100010001000. An "F" indicates the respective fluid actuator (associated with address 0) in each of the three virtual primitives 1, 2, and 3 that is actuated in response to the combination of an actuation data bit and a mask data pattern bit.

For actuation event 1, as shown in FIG. 7B, the mask register controller 702 causes a first shift operation 704-1 to occur in the selected mask register 406. In the example of FIG. 7B, the head of the mask register 406 is shifted into the tail of the mask register 406, and the mask data pattern bits in the mask register 406 are shifted by three bit positions in the example shown. Shifting by three bit positions means that each bit in the mask register 406 is shifted along the shift direction by three positions in the mask register 406. In the example of FIG. 7B, the shift operation 704-1 in response to actuation event 1 causes address 1 to be selected in each virtual primitive. An "F" in FIG. 7B indicates the fluid actuator (associated with address 1) in each virtual primitive that is actuated.

FIG. 7C shows actuation event 2, where the mask register controller 702 causes a second shift operation 704-2 of the selected mask register 406 by three bit positions. The shift operation 704-2 in response to actuation event 2 causes address 2 to be selected.

For actuation event 3, as shown in FIG. 7D, the mask register controller 702 causes a third shift operation 704-3 of the shift register 406 by 3 bit positions. This causes address 3 to be selected.

More generally, the mask register controller 702 is to shift the mask data pattern in the mask register 406 in response to each actuation event of a set of actuation events, where the shifting is to cause enabling of a different set of fluid actuators for each successive actuation event. The shifting of the mask data pattern in the mask register 406 can include a circular shift (as shown in FIGS. 7A-7D), or another type of shift, such as a bi-directional shift, first-in-first-out (FIFO) shift, or any other type of movement of bits in the mask register.

Figure 8:
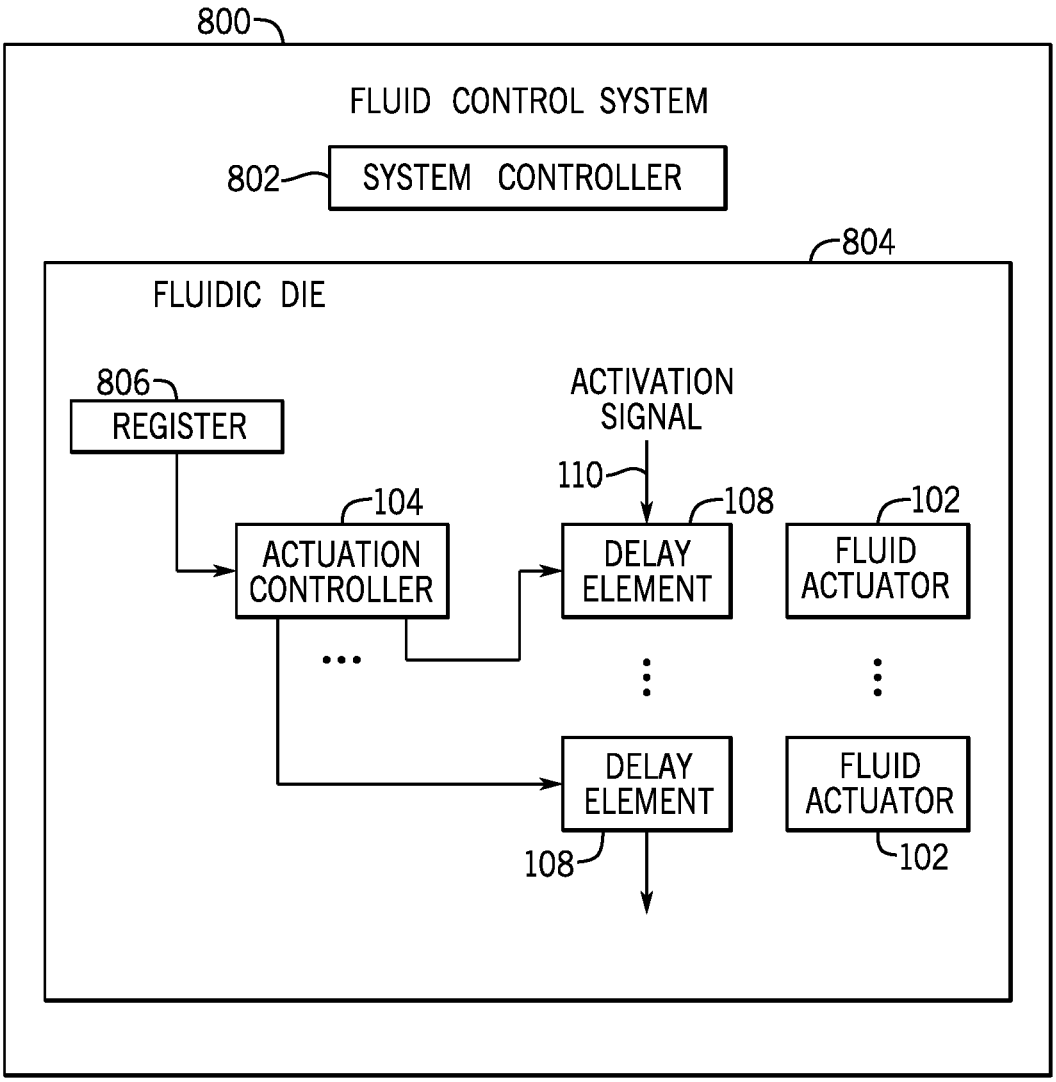
FIG. 8 is a block diagram of a fluid control system according to further examples.

FIG. 8 is a block diagram of an example fluid control system 800, which can be a printing system or any other system in which fluid displacement can be controlled. The fluid control system 800 includes a system controller 802. In a printing system, the system controller 802 is a printer controller.

The fluid control system 800 further includes a fluidic die 804, which includes multiple fluid actuators 102, multiple delay elements 108 associated with the fluid actuators 102, where the delay elements if activated are to delay an activation signal 110.

The fluidic die 804 further includes a register 806 (e.g., the actuation data register 404 and/or the mask register 406 of FIG. 4) to store input control information (which can be provided by the system controller 802) relating to controlling actuation of the multiple fluid actuators 102. The fluidic die also includes an actuation controller 104 to determine, based on the input control information, which fluid actuators 102 are to be actuated. The actuation controller 104 activates delay elements 108 associated with the fluid actuators 102 that are to be actuated, and deactivates delay elements 108 associated with the fluid actuators 102 that are not to be actuated.

Figure 9:
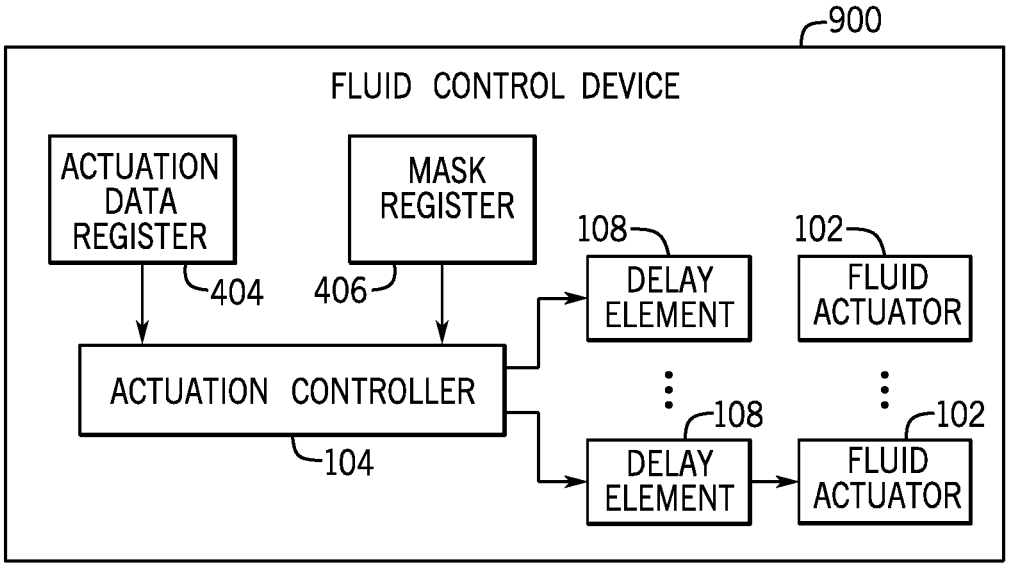
FIG. 9 is a block diagram of a fluid control device according to alternative examples.

FIG. 9 is a block diagram of a fluid control device 900 that includes fluid actuators 102, an actuation data register 404 to store actuation data, a mask registers 406 to store a mask data pattern, and an actuation controller 104 to determine, based on the actuation data and the mask data pattern, whether a first fluid actuator of the fluid actuators 102 is to be actuated. In response to determining that the first fluid actuator is to be actuated, the actuation controller 104 activates a delay element 108 associated with the first fluid actuator.

As noted above, in some examples, certain logic (such as the various controllers) can be implemented as either a hardware processing circuit or as a combination of a hardware processing circuit and machine-readable instructions (software or firmware) executable on the hardware processing circuit.

In examples where machine-readable instructions are employed, the machine-readable instructions can be stored in a non-transitory machine-readable or computer-readable storage medium.

The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluidic die comprising:

a plurality of fluid actuators; and a controller to:

determine, based on input control information relating to controlling actuation of the plurality of fluid actuators, whether a first fluid actuator of the plurality of fluid actuators is to be actuated, in response to determining that the first fluid actuator is to be actuated, activate a delay element associated with the first fluid actuator, the delay element to delay an activation signal propagated to selected fluid actuators of the plurality of fluid actuators in response to an actuation event, and in response to determining that the first fluid actuator is not to be actuated, deactivate the delay element associated with the first fluid actuator such that the activation signal is not delayed by the delay element.

2. The fluidic die of claim 1, further comprising:

a plurality of delay elements individually associated with respective fluid actuators of the plurality of fluid actuators, wherein the controller is to:

determine, based on the input control information, a first subset of the plurality of fluid actuators that are to be actuated, and a second subset of the plurality of fluid actuators that are not to be actuated, and activate delay elements associated with the first subset of the plurality of fluid actuators to delay the activation signal, and deactivate delay elements associated with the second subset of the plurality of fluid actuators.

3. The fluidic die of claim 1, further comprising:

an actuation data register to store actuation data that indicates fluid actuators of the plurality of fluid actuators to actuate, wherein the input control information comprises the actuation data.

4. The fluidic die of claim 3, further comprising:

a mask register to store a mask data pattern indicating a respective set of fluid actuators of the plurality of fluid actuators enabled for actuation for the actuation event, wherein the input control information further comprises the mask data pattern.

5. The fluidic die of claim 4, wherein the controller is to combine a value in the actuation data register with a corresponding value in the mask register to determine whether a respective fluid actuator of the plurality of fluid actuators is to be actuated.

6. The fluidic die of claim 1, wherein the activation signal is to cause actuation of the first fluid actuator, and a delayed instance of the activation signal is to cause actuation of a second fluid actuator of the selected fluid actuators.

7. The fluidic die of claim 1, further comprising:

a mask register to store a mask data pattern indicating a respective set of fluid actuators of the plurality of fluid actuators enabled for actuation for the actuation event, wherein the input control information comprises the mask data pattern that defines a primitive size of a primitive that includes a number of fluid actuators, wherein the controller is to shift the mask data pattern in the mask register in response to each actuation event of a set of actuation events, the shifting to cause enabling of another set of fluid actuators.

8. A fluidic die comprising:

a plurality of fluid actuators;

an actuation data register to store actuation data that indicates fluid actuators of the plurality of fluid actuators to actuate;

a mask register to store a mask data pattern indicating a respective set of fluid actuators of the plurality of fluid actuators enabled for actuation for an actuation event, wherein the mask data pattern defines a primitive size corresponding to a number of fluid actuators in a primitive, the plurality of fluid actuators partitioned across multiple primitives each of the primitive size; and a controller to:

determine, based on the actuation data and the mask data pattern, whether a first fluid actuator of the plurality of fluid actuators is to be actuated, and in response to determining that the first fluid actuator is to be actuated, activate a delay element associated with the first fluid actuator, the delay element to delay an activation signal propagated to selected fluid actuators of the plurality of fluid actuators in response to the actuation event.

9. The fluidic die of claim 8, wherein the mask register is to be loaded with a different mask data pattern to provide a primitive of a different primitive size.

10. The fluidic die of claim 8, wherein the controller is to shift the mask data pattern in the mask register in response to each actuation event of a set of actuation events, the shifting to cause enabling of another set of fluid actuators.

11. A fluid control system comprising:

a system controller; and a fluidic die comprising:

a plurality of fluid actuators;

a plurality of delay elements associated with the fluid actuators, the delay elements if activated to delay an activation signal;

a register to store input control information relating to controlling actuation of the plurality of fluid actuators; and an actuation controller to:

determine, based on the input control information, which fluid actuators of the plurality of fluid actuators are to be actuated, activate delay elements associated with the fluid actuators that are to be actuated, and deactivate delay elements associated with the fluid actuators that are not to be actuated.

12. The fluid control system of claim 11, wherein each of the delay elements is individually associated with a fluid actuator of the plurality of fluid actuators.

13. The fluid control system of claim 11, wherein the register comprises an actuation data register to store actuation data that indicates each fluid actuator of the plurality of fluid actuators to actuate, the fluidic die further comprising:

a mask register to store a mask data pattern indicating a respective set of fluid actuators of the plurality of fluid actuators enabled for actuation for an actuation event, wherein the actuation controller is to determine which fluid actuators of the plurality of fluid actuators are to be actuated further based on the mask data pattern.

14. A fluid control device comprising:

a plurality of fluid actuators;

an actuation data register to store actuation data that indicates each fluid actuator of the plurality of fluid actuators to actuate;

a mask register to store a mask data pattern indicating a respective set of fluid actuators of the plurality of fluid actuators enabled for actuation for a respective actuation event; and a controller to:

determine, based on combining a value in the actuation data register and a corresponding value in the mask register, whether a first fluid actuator of the plurality of fluid actuators is to be actuated, and in response to determining that the first fluid actuator is to be actuated, activate a delay element associated with the first fluid actuator, the delay element to delay an activation signal propagated to selected fluid actuators of the plurality of fluid actuators in response to an actuation event.

15. The fluid control system of claim 13, wherein the mask data pattern defines a primitive size corresponding to a number of fluid actuators in a primitive, the plurality of fluid actuators partitioned across multiple primitives each of the primitive size.

16. The fluid control system of claim 15, wherein the mask register is to be loaded with a different mask data pattern to provide a primitive of a different primitive size.

17. The fluid control system of claim 13, wherein the actuation controller is to combine a value in the actuation data register with a corresponding value in the mask register to determine whether a respective fluid actuator of the plurality of fluid actuators is to be actuated.

18. The fluid control device of claim 14, further comprising:

a plurality of delay elements individually associated with respective fluid actuators of the plurality of fluid actuators, wherein the controller is to:

determine, based on the actuation data and the mask data pattern, a first subset of the plurality of fluid actuators that are to be actuated, and a second subset of the plurality of fluid actuators that are not to be actuated, and activate delay elements associated with the first subset of the plurality of fluid actuators to delay the activation signal, and deactivate delay elements associated with the second subset of the plurality of fluid actuators.

19. The fluid control device of claim 14, wherein the controller is to activate a signal in response to determining that the first fluid actuator is to be actuated, wherein the signal is connected to the delay element to control selective activation of the delay element, the signal when set to a first state causing activation of the delay element, and the signal when set to a different second state causing deactivation of the delay element.

20. The fluid control device of claim 14, wherein the value in the actuation data register is a bit in the actuation data register, and the corresponding value in the mask register is a corresponding bit in the mask register, and wherein the controller comprises an AND logic having inputs to receive the bit in the actuation data register and the corresponding bit in the mask register.

* * * * *